United States Patent [19]

Bergvall

[11] 4,038,516

[45] July 26, 1977

[54] THERMAL PRINTING HEAD

[75] Inventor: Bengt Allan Bergvall, Vasteras, Sweden

[73] Assignee: Facit Aktiebolag, Atvidaberg, Sweden

[21] Appl. No.: 551,267

[22] Filed: Feb. 20, 1975

[51] Int. Cl.[2] ..... H05B 1/00

[52] U.S. Cl. ..... 219/216; 219/505; 219/543; 338/20

[58] Field of Search ..... 219/216, 543, 505; 338/20, 21

[56] References Cited

U.S. PATENT DOCUMENTS

| | | | |
|---|---|---|---|
| 3,478,191 | 11/1969 | Johnson et al. | 219/216 |
| 3,509,072 | 4/1970 | Barrington | 338/21 X |
| 3,515,850 | 6/1970 | Cady, Jr. | 219/543 X |
| 3,805,022 | 4/1974 | Kulwicki | 219/505 |
| 3,825,722 | 7/1974 | Taniguchi | 219/216 |
| 3,833,789 | 9/1974 | Taniguchi | 219/216 |
| 3,965,330 | 6/1976 | Williams | 219/216 |

*Primary Examiner*—C. L. Albritton
*Attorney, Agent, or Firm*—Alfred E. Miller

[57] ABSTRACT

A thermal printing head provided with a plurality of electric heating members for recording information on a recording material, such as heat-sensitive paper. The heating members are voltage-dependent resistive elements and are mounted on a support member in the form of a substrate. Means are provided for the selective supply of current to one or several of the elements. At least some of the elements are constituted of silicon carbide.

9 Claims, 8 Drawing Figures

THERMAL PRINTING HEAD

BACKGROUND OF THE INVENTION

Thermal printing heads are known, for example, devices of the type having characters which are recorded on a heat sensitive paper by means of heating elements which take the form of dots or lines that come in contact with the paper. In this arrangement, the heated spots of paper form a colored reproduction of the heating element due to a chemical reaction which occurs in the surface layer of the paper. Furthermore, heating elements in the form of dots can produce a matrix print, and heating elements in the form of lines or segments may, in the same manner, produce a segment print. The construction usually incorporates a support member, and the whole assembly is called a printing head. However, it is expensive to fabricate a printing head of the type known and used in the prior art. For example, it is costly to apply diodes on a substrate according to thick-film or thin-film techniques. Furthermore, the number of supply conductors to the printing head of the prior art constructions can, of course, be reduced by mounting the drive stages directly on the printing head. However, this construction and arrangement involves great cost. Although the heating elements of the printing head can be produced by the so-called thick-film technique, in the event that diodes or drive circuits are to be utilized on the printing head, this method is also expensive.

The present invention relates to a thermal printing head with a multiplicity of electric heating elements for recording information on a heat-sensitive recording material., such as paper, the head including a support member carrying the elements and further comprising means for the selective supply of current to one or several of said heating elements.

It is an object of the present invention to produce a printing head according to the advantageous and inexpensive thick-film technique without the need of diodes or the like on the printing head.

It is a further object of the present invention to provide a thermal printing head which constitutes heating elements that are voltage-dependent resistive elements. Preferably, a current-voltage characteristic of each voltage-dependent resistive element is such that its resistivity is high at low voltages over the element.

The invention will be more fully described with reference to the accompanying drawings in which:

FIG. 1 - 4 are prior art constructions.

FIGS. 1 - 4 of the prior art constructions will be explained hereinbelow.

The heating elements of the printing head shown in FIGS. 1 - 4 are produced by different methods. One advantageous method is the use of a thick-film technique in which the heating elements are resistive elements applied on a ceramic substrate. The resistive elements and the necessary pattern of electrical conductors are in this method formed by a paste supplied to a substrate by a screen-printing method. Thereafter, the paste is heat-treated at a relatively high temperature.

Another method of producing these heating elements is by the thin-film technique which comprises resistive elements placed on a substrate of glass. Resistive elements can be fabricated of nickel-chromium etched on a surface layer. In the same manner another pattern of conductors for example, aluminum, can also be produced.

The heating elements may also be made by a known semiconductor fabrication technique in which the heating elements are resistive elements in the form of doped islands in a thin silicon plate. The selected pattern of conductors is formed by applying an aluminum layer which has been etched according to a predetermined pattern. Since it is uneconomical to produce silicon plates of a size larger than 20–30 mm.$^2$, one or several plates have to be applied on a thick-film substrate by a comparatively complicated and expensive process.

The heating elements can be arranged in a different manner on the printing head dependent upon the desired printing method to be used. Three representative methods will be outlined below.

Method 1

Figure 1:
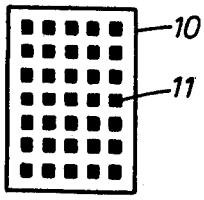
FIGS. 1 - 3 are diagrammatic views showing the printing head of various configurations.

The printing head comprises heating elements for simultaneously printing of a complete character. Generally the character is formed by 35 dots arranged in a matrix of $5 \times 7$ dots. This construction and arrangement is illustrated in FIG. 1. Furthermore in FIGS. 1 - 3 the printing head is denoted by the reference character 10 and the heating element by the reference character 11. The printing head moves laterally if a whole line of characters is to be printed by means of the printing head as illustrated in FIG. 1. Moreover, when one line has been printed the paper is moved up vertically before the next line is printed below.

Method 2

Figure 2:
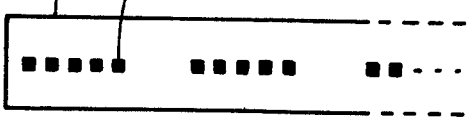

The printing head has a given number of heating elements for each character in the whole row of characters. Generally speaking the printing head is provided with five horizontally arranged dot-shaped heating elements for each character, as shown in FIG. 2. Thus, for example, for a printing head designed for 12 characters, that is $5 \times 12 = 60$ heating elements are required. Thus, when a line of characters is to be printed on the recording material the selected heating elements are heated, the paper is moved vertically a distance corresponding to 1/7 of the height of a character. Then, the relevant elements are again heated and the paper moved further, etc., until the whole line of characters is complete. Before the next line of characters is to be printed, the paper must be moved an additional distance vertically.

Method 3

Figure 3:
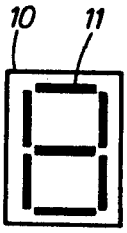

In this arrangement, the printing head contains all the heating elements that is necessary for printing a whole line of characters at one time. In such printing heads, characters are formed by numerals composed by seven different segments. This particular arrangement and construction is illustrated in FIG. 3. Thus, for a printing head intended for 12 numerals, $7 \times 12 = 84$ segments are necessary.

Suitable drive circuits are required in order to pass current through the elements to be heated. If each heating element should be separately connected to its drive circuit several conductors would have to be led to the printing head which may involve practical difficulties. Moreover, if a common supply conductor is utilized the following number of supply conductors will be necessary in the above three methods:

Method 1, 36 supply conductors; Method 2, 61 supply conductors; Method 3, 85 supply conductors.

These conductors will be located very close to one another, therefore the costs for these connections will be very high. Furthermore, this assembly will be expensive because many drive stages are required.

The cost of the above, however, can be reduced by connecting the heating elements in a matrix by which a number of supply conductors can be materially reduced as follows: Method 1: 12 supply conductors; Method 2: 17 supply conductors and Method 3: 19 supply conductors.

Figure 4:
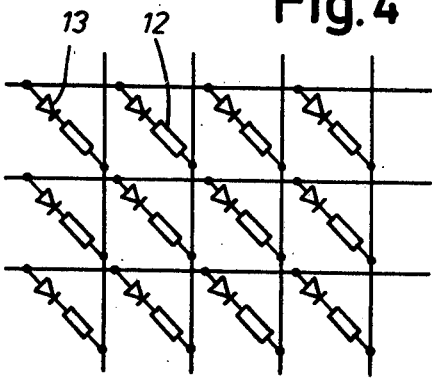
FIG. 4 is a diagrammatic view showing the heating elements connected in a diode matrix.

In the matrix arrangement described above, there must be some means to prevent the current from heating unwanted heating elements. In general, a diode is connected in series with each heating element in the matrix and this arrangement is illustrated in FIG. 4 in which the heating elements are represented by resistors 12 and the diodes are denoted by the reference numeral 13.

A further advantage of the matrix connection is that, in addition, the number of drive stages is reduced. However, if more than one resistive element is to be connected at a time the drive stages must be dimensioned at a higher current than in the case when a matrix connection has not been used.

It is to be observed, however, that the number of supply conductors to the printing head is reduced only if the diodes can be mounted directly on the printing head. This is accomplished by means of a semi-conductor technique in which diodes are made directly on the silicon plates. However, both with and without diodes on the printing heads, use of the semi-conductor technique is relatively expensive. Furthermore, it is also expensive to apply diodes on a substrate according to the thick-film or thin-film techniques explained hereinbefore.

In addition, the number of supply conductors to the printing head may be reduced by mounting the drive stages directly on the printing head. Since this construction and arrangement involves a large cost, this method is not very attractive.

From the above disclosure, it appears evident that the thick-film techniques seem to be the most advantageous method in producing printing heads. However, in the event diodes or drive circuits are to be applied on the head, this method is also expensive. In view of the many difficulties of the prior art construction the present invention appears to be distinctly advantageous in that the production of the printing head according to the inexpensive thick-film technique is possible without the need of diodes or the like on the printing head. Furthermore, the thermal printing head, constructed and arranged in accordance with the present invention, is characterized in that the heating elements are voltage-dependent resistive elements. In a preferred embodiment of the invention the current-voltage characteristic of each voltage-dependent resistive element is such that its resistivity is high at low voltages over the element.

Referring now to FIGS. 5–8 a printing head is shown constructed according to the teachings of the present invention in which production is achieved using the inexpensive thick-film technique and without utilizing diodes or the like on the printing head. The thermal printing head fabricated in accordance with the principles of the present invention is mainly comprised of heating members that are voltage-dependent resistive elements known as VDR elements or varistor elements. Furthermore, in a preferred embodiment of the present invention, the current-voltage characteristic of each voltage-dependent resistive element is such that its resistivity is high at low voltages over the element.

Figure 5:
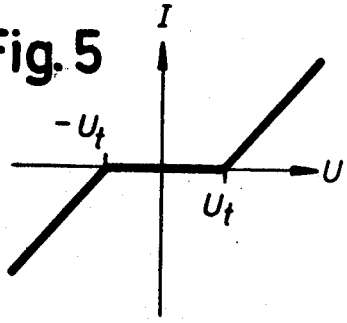
FIGS. 5, 7–8 show different diagrammatic views of the characteristics of the voltage-dependent resistive elements constructed and arranged according to the teachings of the present invention.

A heating member constructed in accordance with the present invention may consist of a voltage-dependent resistive element having the current-voltage characteristic as shown in FIG. 5. It will be seen that at low voltages a very high resistivity is obtained, and there will be a current flow through the resistive element only when the threshold voltage $U_t$ or $-U_t$ has been exceeded.

Figure 6:
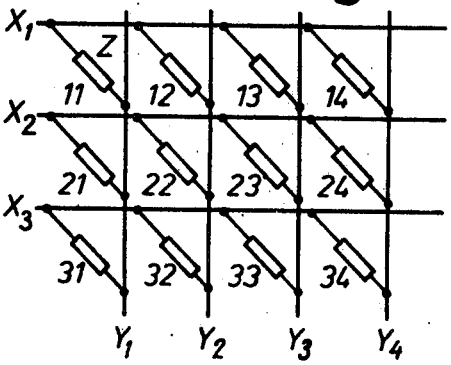
FIG. 6 shows a matrix with a voltage dependent resistive element also constructed in accordance with the teachings of the present invention.

As seen in FIg. 6, the resistive elements Z of the characteristic shown and described in connection with FIG. 5, are connected in a matrix having horizontal conductors $X - X_3$ and vertical conductors $Y_1 - Y_4$. In regard to FIG. 6, and for example, if a voltage E is connected to the conductor $X_2$ and the conductor $Y_3$ is grounded while all the other connections remain open, a heat flow will pass through the element $Z_{23}$. Accordingly, the condition prevailing is that the voltage E is greater than the threshold voltage $U_t$. Furthermore, unwanted electrical currents will flow through the remainder of the resistive elements but applicable to all of these current paths is the condition that the curent must pass through at least three elements in series. One of the above-mentioned current paths is, for example, from $X_2$ through $Z_{21}$, $Z_{31}$ and $Z_{33}$ to $Y_3$. Since each resistive element Z has a threshold voltage $U_t$ which has to be exceeded before current can pass through the resistive element, a voltage E is necessary which is greater than $3 \times U_3$ before an unwanted current can be produced.

It should be apparent that if E, as selected, is greater than $U_t$ but less than $3 \times U_t$, there will be only a current flow through a selected resistive element, for example $Z_{23}$, as set forth in the example above.

Figure 7:
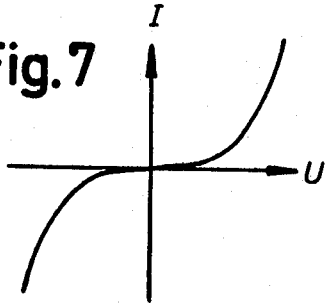

The ideal characteristic as illustrated in FIG. 5 cannot be achieved with known material available for fabricating resistive elements. However, as seen in FIG. 7, a curve is shown which illustrates the characteristics that can be obtained by using resistive elements of silicon carbide. It will be observed that a well-defined threshold voltage cannot be achieved but the above-mentioned voltage E can be readily selected so that no harmful current will flow through the non-selected elements.

Figure 8:
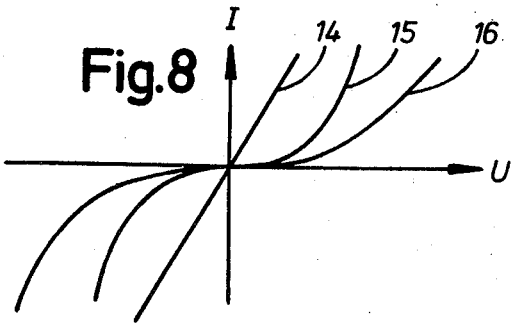

It can be seen from observing the slope of the characteristic of FIG. 7 for higher voltages the slope is very steep and therefore the current through the selected resistive element will be very much voltage-dependent. This disadvantage can be removed, however, if the voltae-dependent resistive element is combined with a linear resistive element. Referring now to FIg. 8 in which is shown a characteristic 14 of a linear resistive element together with a characteristic curve 15 of voltage-dependent resistive element, for example, silicon carbide. The new voltage-dependent resistive element thus formed will have a characteristic curve 16, as also illustrated in FIG. 8. If a voltage-dependent resistive element of the characteristic curve 16 is used in a printing head, the unwanted currents will be sufficiently small and, at the same time, the voltage sensitivity will not be troublesome. In that arrangement, the above-mentioned voltage E may have a value that is very close to the voltage $3 \times U_t$.

Moreover, the above combination of resistive elements may be in the form of a series of two different elements. Furthermore, it is possible to use a combination of resistive materials of non-linear respectively linear characteristics.

It should be noted further that if a printing head with voltage-dependent resistive elements according to the present invention is utilized, these elements should be provided with wear protection, for example glass, which is applied in a known manner.

The present printing head may be produced by simple and inexpensive manufacturing techniques. Moreover, no special expensive fabricating equipment is necessary to make the printing head in accordance with the teachings of the present invention.

What is claimed is:

1. A thermal printing head comprising a plurality of electric heating elements for recording information on a recording medium, a support member mounting said heating elements, said heating elements being varistor elements, said varistor elements each comprising a series combination of an element having non-linear current-voltage characteristics and a resistor having linear current-voltage characteristics, and means for the selective supply of the electric current to at least one of said varistor elements.

2. The thermal printing head as claimed in claim 1 wherein said recording medium is a heat-sensitive recording material.

3. The thermal printing head as claimed in claim 1 wherein the current-voltage characteristic of each varistor element is such that its resistivity is high at low voltages on the element.

4. The thermal printing head as claimed in claim 1 wherein a layer of wear protection is applied on the exterior surface of each varistor element.

5. The thermal printing head of claim 1 wherein said resistors having non-linear current-voltage characteristics comprise silicon-carbide elements.

6. The thermal printing head as claimed in claim 1 wherein said support member is a substrate, and the varistor elements are thick-film elements that are applied on said substrate.

7. The thermal printing head as claimed in claim 6 wherein said thick-film elements are formed by paste applied on the substrate.

8. The thermal printing head as claimed in claim 7 wherein said paste on said substrate is heat treated.

9. The thermal printing head as claimed in claim 6 wherein said paste is at least partly constituted of silicon-carbide.

* * * * *